US009956560B2

(12) United States Patent
Landes et al.

(10) Patent No.: US 9,956,560 B2
(45) Date of Patent: May 1, 2018

(54) PIPETTE TIP CONTAINERS

(71) Applicant: ORIGIO Inc., Charlottesville, VA (US)

(72) Inventors: Louis Mark Landes, Fishersville, VA (US); Pasquale Mangiola, Lyndhurst, VA (US)

(73) Assignee: ORIGIO Inc., Charlottesville, VA (US)

( * ) Notice: Subject to any disclaimer, the term of this patent is extended or adjusted under 35 U.S.C. 154(b) by 589 days.

(21) Appl. No.: 14/609,484

(22) Filed: Jan. 30, 2015

(65) Prior Publication Data

US 2015/0238969 A1 Aug. 27, 2015

Related U.S. Application Data

(60) Provisional application No. 61/942,742, filed on Feb. 21, 2014.

(51) Int. Cl.

| | |
|---|---|
| ***B65D 83/02*** | (2006.01) |
| ***B01L 9/00*** | (2006.01) |
| ***A61D 19/02*** | (2006.01) |
| ***B65D 85/24*** | (2006.01) |
| ***B65D 41/18*** | (2006.01) |
| ***B65D 85/20*** | (2006.01) |

(52) U.S. Cl.

CPC ..... *B01L 9/54* (2013.01); *A61D 19/024* (2013.01); *B01L 9/543* (2013.01); *B65D 41/18* (2013.01); *B65D 83/02* (2013.01); *B65D 85/20* (2013.01); *B65D 85/24* (2013.01); *B01L 2200/12* (2013.01); *B01L 2300/043* (2013.01); *B01L 2300/0832* (2013.01); *B01L 2300/0858* (2013.01)

(58) Field of Classification Search

CPC .. A47G 21/12; A61B 50/3001; A61D 19/024; B01L 2300/0043; B01L 2300/043; B01L 2300/042; B01L 2300/0838; B01L 19/54; B01L 19/543; B01L 19/547; B65D 83/02; B65D 85/20; B65D 85/24

USPC ..... 206/443; 221/306

See application file for complete search history.

(56) References Cited

U.S. PATENT DOCUMENTS 1,080,248 A * 12/1913 Bell ..... A47G 21/12 221/312 R 3,212,670 A * 10/1965 Tint ..... A61B 17/205 206/367

(Continued)

OTHER PUBLICATIONS

Transmittal of International Preliminary Report on Patentability for International Application No. PCT/US2015/013680 dated Sep. 1, 2016 (7 pages).

(Continued)

*Primary Examiner* — Anthony Stashick
*Assistant Examiner* — Mollie Impink
(74) *Attorney, Agent, or Firm* — Fish & Richardson P.C.

(57) ABSTRACT

A pipette tip container includes an elongate tube that includes a sidewall that defines an interior region and an open end of the elongate tube. The elongate tube further includes an annular protrusion that extends along an inner circumference of the sidewall, wherein the annular protrusion is configured so that a pipette tip contacts the elongate tube at the annular projection and at a point along the sidewall located near the open end of the elongate tube when the elongate tube is lying on its sidewall. The pipette tip container further includes a cap secured to the open end of the elongate tube and formed to allow passage of the pipette tip.

20 Claims, 2 Drawing Sheets

(56) References Cited

U.S. PATENT DOCUMENTS

| | | | | |
|---|---|---|---|---|
| 3,607,098 | A | 9/1971 | Strande | |
| 4,227,620 | A | 10/1980 | Conway | |
| 4,859,423 | A * | 8/1989 | Perlman | A61L 2/26 206/214 |
| 4,942,966 | A | 7/1990 | Kemp | |
| 5,257,984 | A | 11/1993 | Kelley | |
| 5,323,902 | A * | 6/1994 | Palmer | A61B 50/362 206/366 |
| 6,062,001 | A * | 5/2000 | Kunik | A61M 5/3205 206/366 |
| 2006/0210448 | A1* | 9/2006 | Wang | A61B 10/0038 422/400 |
| 2007/0125675 | A1* | 6/2007 | Booker | A61D 19/024 206/438 |
| 2009/0209044 | A1* | 8/2009 | Gallagher | A61B 10/0045 436/174 |
| 2010/0000905 | A1* | 1/2010 | Wang | B65D 83/02 206/569 |
| 2017/0182489 | A1* | 6/2017 | Ebetsberger | B01L 3/5021 |

OTHER PUBLICATIONS

International Search Report and Written Opinion for International Application No. PCT/US2015/013680 dated Apr. 24, 2015 (9 pages).

* cited by examiner

PIPETTE TIP CONTAINERS

CROSS-REFERENCE TO RELATED APPLICATION

Under 35 U.S.C. § 119, this application claims the benefit of prior U.S. provisional application 61/942,742, filed Feb. 21, 2014, which is incorporated in its entirety herein by reference.

TECHNICAL FIELD

This disclosure relates to pipette tip containers.

BACKGROUND

Various containers (e.g., tubes and multi-well boxes) may be used to store pipette tips in a sterile or non-sterile manner. Pipette tips can be individually retrieved from a tip container and secured to a pipettor for transferring (e.g., aspirating, denuding, and/or depositing) volumes of fluid substances (e.g., liquid media and/or cells) to carry out various experimental or biological procedures in laboratory and clinical environments. Certain tip containers (e.g., tubular containers) may include dispensing caps that are formed to allow passage of a single pipette tip.

SUMMARY

In one aspect of the invention, a pipette tip container includes an elongate tube that includes a sidewall that defines an interior region and an open end of the elongate tube. The elongate tube further includes an annular protrusion that extends along an inner circumference of the sidewall, wherein the annular protrusion is configured so that a pipette tip contacts the elongate tube at the annular projection and at a point along the sidewall located near the open end of the elongate tube when the elongate tube is lying on its sidewall. The pipette tip container further includes a cap secured to the open end of the elongate tube and formed to allow passage of the pipette tip.

Embodiments can include one or more of the following features.

In certain embodiments, the elongate tube further includes a rounded end portion opposite the open end.

In some embodiments, the annular protrusion extends radially inward about 0.004 inch to about 0.010 inch from the sidewall.

In certain embodiments, the annular protrusion is located about 2.6 inch to about 3.0 inch from the open end of the elongate tube.

In some embodiments, the annular protrusion is configured so that the pipette tip is oriented at an angle of about 0.5° to about 0.8° with respect to a central axis of the elongate tube when the pipette tip is in contact with the annular protrusion and the elongate tube is lying on its sidewall.

In certain embodiments, the annular protrusion is configured so that the pipette tip is in contact with the elongate tube along no more than about 5% to about 7% of a length of the pipette tip when the pipette tip is in contact with the annular protrusion and the elongate tube is lying on its sidewall.

In some embodiments, the pipette tip container exhibits no measurable charge while holding the pipette tip.

In certain embodiments, charge is a measure of static electricity.

In some embodiments, the elongate tube is made of polypropylene.

In certain embodiments, the elongate tube is sized to hold multiple pipette tips.

In some embodiments, the cap is formed to allow passage of one pipette tip at a time.

In certain embodiments, the cap includes a dispenser and a lid.

In some embodiments, the dispenser includes a lip that is formed to snap onto the open end of the elongate tube.

In certain embodiments, the dispenser defines an aperture sized to allow passage of the pipette tip.

In some embodiments, the dispenser further defines a cone-shaped channel that guides the pipette tip toward the aperture.

In certain embodiments, the lid includes a hinge that allows the lid to swing open and closed with respect to the dispenser.

In some embodiments, the lid includes an insert sized to pass through the aperture of the dispenser.

In certain embodiments, the elongate tube can range in length from about 3.7 inches to about 4.1 inches.

In some embodiments, the elongate tube is formed using an injection mold.

In certain embodiments, the pipette tip container is configured to store the pipette tip in a sterile manner.

Embodiments can include one or more of the following advantages.

In some embodiments, the annular protrusion of the elongate tube provides a single tangent point that minimizes contact between pipette tips and the elongate tube, such that the pipette tips contact the inner surface of the sidewall at only two points (i.e., the tangential point provided by the annular protrusion and an end of the pipette tip that rests against the elongate tube near the open end of the elongate tube). In this manner, the annular protrusion positions the pipette tips apart from the tube sidewall along a majority of the length of the pipette tips and thereby prevents the pipette tips from contacting an inner surface of the tube sidewall along a majority of the length of the pipette tips. For example, a pipette tip may contact the inner surface of the tube sidewall along no more than about 5% to about 7% of the length of the pipette tip, while the remaining portion of the length remains free from contact with the inner surface of the tube sidewall.

Such minimal contact between the pipette tips and the elongate tube can significantly reduce an amount of static electricity generated in the pipette tip container, as compared to an amount of static electricity that may be generated within conventional pipette tip containers that do not include an annular protrusion. For example, in conventional tube containers that do not include an internal protrusion, pipette tips can contact an inner surface of the tube wall (e.g., tangentially) along a majority of the length of the pipette tips as the pipette tips roll around within the container. Such extensive contact between the pipette tips and the tube wall can generate a significant amount of static electricity within the container that causes the pipette tips to stick to the tube wall, providing resistance to removal of an individual pipette tip from the container and potential damage to the pipette tip as an increased force is exerted on the pipette tip to overcome the resistance.

Other aspects, features, and advantages will be apparent from the description, the drawings, and the claims.

DETAILED DESCRIPTION

Figure 1:
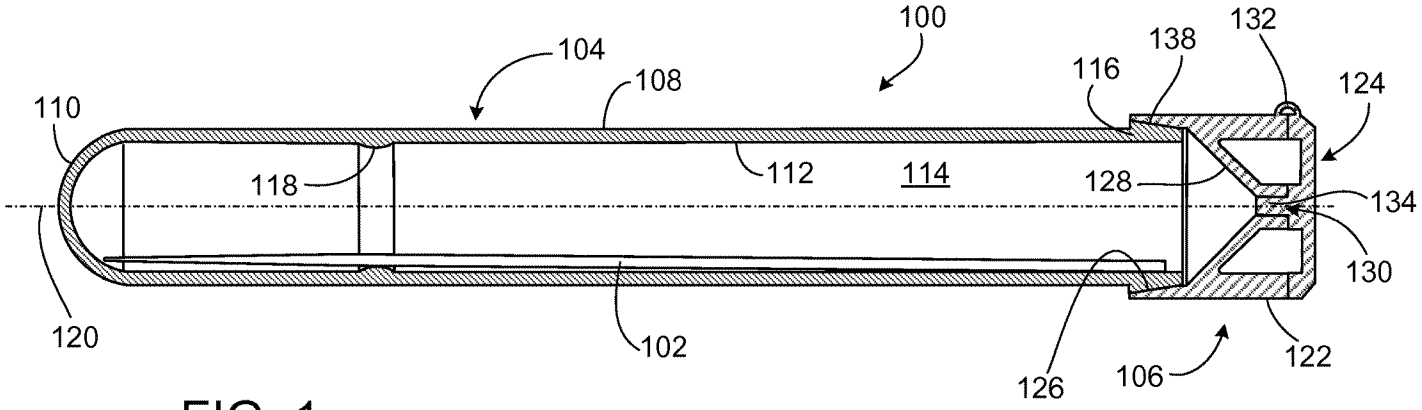
FIG. 1 is a cross-sectional view of a container storing a pipette tip with a cap in a closed configuration.
Figure 2:
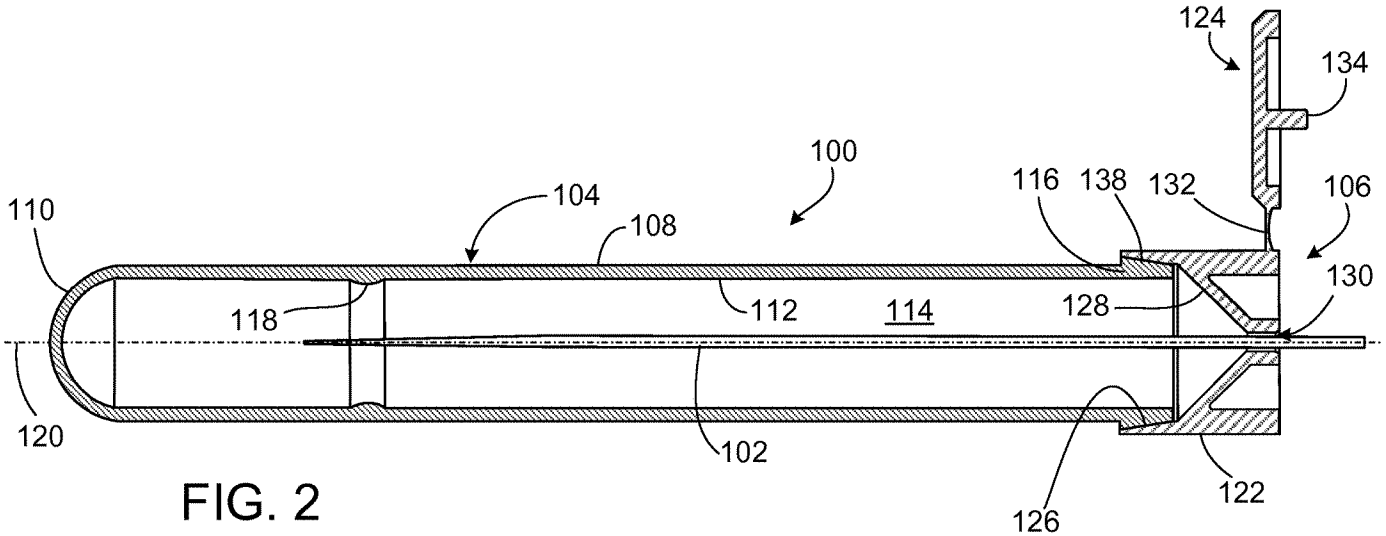
FIG. 2 is cross-sectional view of the container of FIG. 1 with a pipette tip passed through the cap in an open configuration.

FIGS. 1 and 2 illustrate a container 100 that is used for storing one or more pipette tips 102 in a sterile manner (only one pipette tip 102 is shown for clarity). The container 100 includes a tube 104 and a cap 106 (shown in a closed configuration in FIG. 1 and in an open configuration in FIG. 2) that is secured to an end of the tube 104. The tube 104 is formed to hold the pipette tips 102 (as shown in FIG. 1), and the cap 106 is formed to dispense a single pipette tip 102 from the container 100 (as shown in FIG. 2). During use, a user can open the cap 106 of the container 100, move (e.g., gently shake or otherwise manipulate) the container 100 until an end of a single pipette tip 102 passes through the cap 106, and remove the pipette tip 102 from the container 100. The pipette tip 102 can then be secured to a pipettor for transferring (e.g., aspirating, denuding, and/or depositing) volumes of fluid substances (e.g., liquid media and/or cells) to carry out various experimental or biological procedures in laboratory and clinical environments.

The tube 104 is sized to hold multiple (e.g., twenty) pipette tips 102 at a time. The tube 104 includes an elongate sidewall 108 and a rounded end portion 110 (e.g., a semi-spherical shaped portion) that together form a tube wall 112 and define an interior region 114 of the tube 104. The elongate sidewall 108 defines an open end 116 of the tube 104 to which the cap 106 is secured. The elongate sidewall 108 further defines a circumferential taper 138 (e.g., a reverse taper) disposed along the open end 116 of the tube 104. The circumferential taper 138 helps to secure the cap 106 snuggly to the open end 116 of the tube 104.

The tube 104 has a total length of about 3.7 inches to about 4.1 inches (e.g., 3.9 inches), and the tube wall 112 has a thickness of about 0.02 inch to about 0.06 inch (e.g., 0.04 inch). The tube 104 has an inner diameter of about 0.3 inch to about 0.5 inch (e.g., 0.4 inch). The circumferential taper 138 of the tube 104 has a maximum diameter of about 0.4 inch to about 0.6 inch (e.g., about 0.5 inch). The tube wall 112 includes a protrusion 118 (e.g., an annular hump with a rounded surface) that extends along a circumference of the tube wall 112 and into the interior region 114 of the tube 102. The protrusion 118 extends radially inward about 0.004 inch to about 0.010 inch (e.g., about 0.004 inch) from an inner surface of the tube wall 112 and has a radius of about 0.1 inch to about 0.3 inch (e.g., about 0.2 inch). The protrusion 118 is positioned about 2.6 inches to about 3.0 inches (e.g., about 2.8 inches) from the open end 116 of the tube 104, such that a pipette tip 102 in tangential contact with the protrusion 118 is oriented about 0.5° to about 0.8° (e.g., about 0.5°) with respect to a central axis 120 of the container 100 when the tube 104 is lying on its elongate sidewall 108, as shown in FIG. 1.

Referring particularly to FIG. 1, the protrusion 116 of the tube 104 provides a single tangent point between the pipette tips 102 and the tube 104, such that the pipette tips 102 contact the inner surface of the tube wall 112 at only two points (i.e., the tangential point provided by the protrusion 118 and an end of the pipette tips 102 that rests against the elongate sidewall 108 near the open end 116 of the tube 104). In this manner, the protrusion 118 positions the pipette tips 102 apart from the tube wall 112 along a majority of the length of the pipette tips 102 and thereby prevents the pipette tips 102 from contacting an inner surface of the tube wall 112 along a majority of the length of the pipette tips 102. For example, a pipette tip 102 may contact the inner surface of the tube wall 112 along no more than about 5% to about 7% (e.g., about 5%) of the length of the pipette tip 102, while the remaining portion of the length remains free from contact with the inner surface of the tube wall 112.

Such minimal contact between the pipette tips 102 and the tube 104 significantly reduces an amount of static electricity generated in the container 100, as compared to an amount of static electricity that may be generated within conventional pipette tip containers that do not include an annular protrusion. For example, in conventional tube containers that do not include an internal protrusion such, pipette tips can contact an inner surface of the tube wall (e.g., tangentially) along a majority of the length of the pipette tips as the pipette tips roll around within the container. Such extensive contact between the pipette tips and the tube wall can generate a significant amount of static electricity within the container that causes the pipette tips to stick to the tube wall, providing resistance to removal of an individual pipette tip from the container and potential damage to the pipette tip as an increased force is exerted on the pipette tip to overcome the resistance.

Static electricity testing has shown that the container 100 and the pipette tips 102 exhibit zero charge following a protocol including charging (e.g., triboelectrically charging) the container 100 and the pipette tips 102, removing all charge (e.g., via ionization) from the container 100 and the pipette tips 102, placing the pipette tips 102 inside of the container 100, moving the pipette tips 102 around within the container 100, and removing the pipette tips 102 from the container 100. In contrast, static electricity testing performed on the pipette tips 102 with a similar conventional tip container including the cap 106 and without an inner protrusion, showed that the conventional tip container and the pipette tips 102 exhibited charges up to thousands of Volts when subjected to the same static electricity testing protocol. Thus, the structure of the tube 104 reduces or even prevents generation of static electricity following placement of non-charged pipette tips 102 within a non-charged container 100.

Referring to FIGS. 1 and 2, the cap 106 is a snap-fit cap that is secured to the open end 116 of the tube 104. The cap 106 includes a dispenser 122 and a lid 124 that may be opened and closed from the dispenser 122. The dispenser 122 includes a lip 126 that can be snap-fitted onto the circumferential taper 138 of the tube 104. The dispenser 122 and the lid 124 have an outer diameter of about 0.5 inch to about 0.7 inch (e.g., about 0.6 inch), and the lip 126 has an inner diameter of about 0.3 inch to about 0.5 inch (e.g., about 0.4 inch). The dispenser 122 defines a cone-shaped channel 128 that extends from the lip 126, and an aperture 130 that extends from the cone-shaped channel 128 to an outer edge of the dispenser 122. A wall of the cone-shaped channel 128 is oriented at about 30° to about 60° (e.g., about 45°) with respect to the central axis 120 of the container 100 and serves to gather and guide ends of the pipette tips 102 towards the aperture 130. The aperture 130 is sized to allow passage of a single pipette tip 102 for removal of the pipette tip 102 from the container 100. The aperture 130 has an inner diameter of about 0.05 inch to about 0.07 inch (e.g., about 0.06 inch). The lid 124 of the cap 106 includes a hinge 132 that allows the lid 124 to swing open (as shown in FIG. 2) and closed (as shown in FIG. 1) with respect to the dispenser 122, an insert 134 sized to pass through the aperture 130 when the lid 124 is closed, and a thumb extension (not shown in cross-section) that can be pushed or pulled to open the lid 124 from the dispenser 122.

Either or both of the tube 104 and the cap 106 may be made of one or more antistatic materials or other materials that minimize generation of static electricity, such as polypropylene, polystyrene (e.g., crystal polystyrene), polycarbonate (e.g., clear thermoplastic polycarbonate), and polyethylene (e.g., high-density polyethylene, HDPE). The tube 104 may further be coated with one or more antistatic materials or other materials that minimize generation of static electricity, such as carbon or another material. Such antistatic materials can reduce static or reduce friction between the pipette tip 102 and the tube wall 112.

For example, surface resistivity testing (e.g., using a surface resistivity meter) of the tube 104 (e.g., when the tube 104 is made of polypropylene) has shown that the tube 104 has a surface resistivity of about $10^{10}$ ohm/square, whereas the surface resistivity testing of tubular tip containers made of other materials (e.g., polystyrene) have surface resistivities of greater than $10^{12}$ ohm/square. Furthermore, static electricity testing of the tube 104 (e.g., when the tube 104 is made of polypropylene) has shown that the tube 104 exhibits no measurable charge following rubbing the tube 104 by hand and across various surfaces, whereas tubular tip containers made of other materials (e.g., polystyrene) showed charges of about 5 kV to about 10 kV following such rubbing of the tubes.

Figure 3:
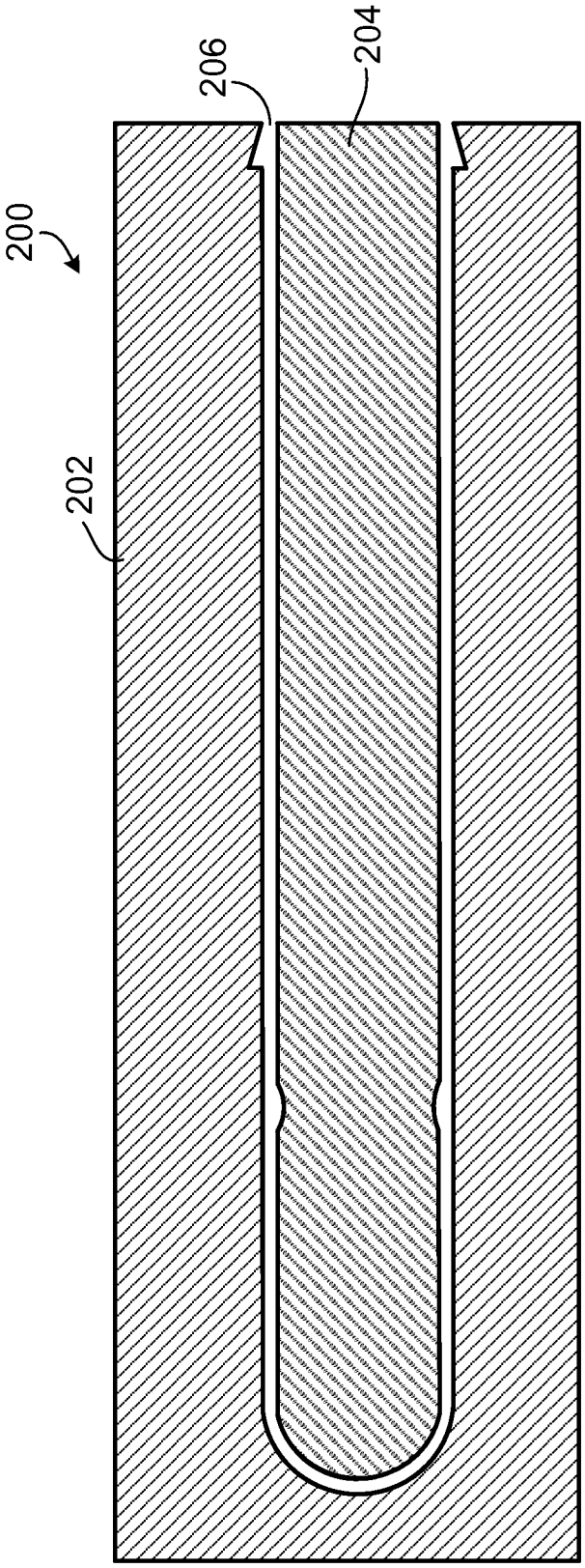
FIG. 3 is a cross-sectional view of an injection mold for forming a tube of the container of FIGS. 1 and 2.

The tube 104 and the cap 106 of the container 100 can be manufactured via injection molding. For example, FIG. 3 illustrates an injection mold 200 that includes an outer mold 202 and an inner mold 204 for forming the tube 104. The outer mold 202 forms an outer surface of the tube 104, and the inner mold 204 forms an inner surface (e.g., including the protrusion 118) of the tube wall 112. Following sufficient solidification of a molten material injected within a cavity 206 defined by the molds 202, 204, the outer mold 202 is removed from the outside of the tube 104. When the outer mold 202 is removed, the tube 104 is sufficiently flexible (e.g., while heated) such that the tube 104 can stretch while being removed from (e.g., pushed off of) the inner mold 204 without the protrusion 118 preventing such removal of the tube 104. Upon removal of the tube 104 from the inner mold 204, the tube 104 cools while retracting to its initial mold shape. The container 100 and the pipette tips 102 may be sterilized (e.g., via gamma radiation) either before or after placement of the pipette tips 102 within the container 100.

The pipette tips 102 may be formed in several sizes that are appropriate for carrying out various procedures (e.g., experimental and biological procedures) in laboratory and clinical environments. Such example procedures include in vitro fertilization (IVF) techniques, intracytoplasmic sperm injections (ICSI), and preimplantation genetic diagnosis (PGD) techniques. Accordingly, the pipette tips 102 can be used to transfer (e.g., aspirate, denude, and/or deposit) volumes of fluid substances, such as liquid media and/or cells. Example cells that may be transferred by the pipette tips 102 include sperm cells, cumulus cells that surround oocytes, zygotes, embryos, and blastomeres. The pipette tips 102 may range in length from about 2.8 inches to about 3.8 inches and range in maximum outer diameter from about 0.03 inch to about 0.12 inch. The pipette tips 102 may be made of one or more materials (e.g., polycarbonate) that are sufficiently flexible for carrying out procedures such as the procedures mentioned above.

Referring to FIG. 2, the container 100 may be manipulated to extend a pipette tip 102 through the cap 106. In order to retrieve an individual pipette tip 102 from the container 100, a user can open the lid 124 of the cap 106, move (e.g., gently shake or otherwise manipulate) the container 100 until an end of a single pipette tip 102 passes through the aperture 130 of the dispenser 122, and grasp the extended pipette tip 102 to remove the pipette tip 102 from the container 100. The pipette tip 102 can then be secured to a plunger of a pipettor for transferring (e.g., aspirating, denuding, and/or depositing) volumes of fluid substances (e.g., liquid media and/or cells) to carry out various experimental or biological procedures in laboratory and clinical environments. The pipette tip 102 may be removed from the container 100 without having to overcome static electricity forces that can build up in conventional tubular tip containers that do not include a circumferential protrusion.

While the tube 104 and the cap 106 of the container 100 have been described as having certain feature dimensions, in some embodiments, a tip container may include a tube and a cap that have one or more feature dimensions different from those of the tube 104 and the cap 106.

While the protrusion 118 has been described as an annular hump that has a rounded surface, in some embodiments, a tip container may include a tube that has one or more internal protrusions with non-rounded surfaces.

While the tube 104 has been described as including a rounded end portion 110, in some embodiments, a tip container may include a tube that has a flat (e.g., square-shaped) end portion or other non-rounded end portion.

While the cap 106 has been described as a snap-fit cap, in some embodiments, a tip container may include a screw cap and a tube with a threaded open end portion for accepting such a screw cap.

A number of embodiments have been described. Nevertheless, it will be understood that various modifications may be made without departing from the spirit and scope of the claims.

What is claimed is:

1. A pipette tip container, comprising:

an elongate tube having a first length and a first inner diameter, the elongate tube configured to hold a pipette tip having a second length that is greater than half of the first length and the pipette tip having a second outer diameter that is less than half of the first inner diameter of the elongate tube, the elongate tube comprising:

a sidewall that defines the first inner diameter of the elongate tube and that defines an open end of the elongate tube, a rounded end portion that has a concave inner surface, that is opposite the open end, and that, together with the sidewall, defines an interior region of the elongate tube, and an annular protrusion that is axially spaced apart from the rounded end portion, that extends radially inward along the first inner diameter defined by the sidewall, and that is formed as a rounded hump, such that when the elongate tube is holding the pipette tip within the interior region and when the elongate tube is lying on the sidewall, the elongate tube contacts a side surface of the pipette tip at only two points along the elongate tube, the two points including a first point along the sidewall located near the open end of the elongate tube and a second point on the annular protrusion; and a cap secured to the open end of the elongate tube and formed to allow passage of the pipette tip.

2. The pipette tip container of claim 1, wherein the annular protrusion extends radially inward about 0.004 inch to about 0.010 inch from the sidewall.

3. The pipette tip container of claim 1, wherein the annular protrusion is located about 2.6 inches to about 3.0 inches from the open end of the elongate tube.

4. The pipette tip container of claim 2, wherein the annular protrusion is configured so that when the elongate tube is holding the pipette tip within the interior region and when the elongate tube is lying on the sidewall, a central axis of the elongate tube is oriented at an angle of about 0.5° to about 0.8° with respect to the pipette tip.

5. The pipette tip container of claim 4, wherein the annular protrusion is configured so that when the elongate tube is holding the pipette tip within the interior region and when the elongate tube is lying on the sidewall, the elongate tube contacts the pipette tip along no more than about 5% to about 7% of the second length of the pipette tip.

6. The pipette tip container of claim 1, wherein the annular protrusion is configured so that when the elongate tube is holding the pipette tip, the pipette tip container exhibits substantially no measurable charge following rubbing of the pipette tip container by hand.

7. The pipette tip container of claim 6, wherein charge is a measure of static electricity.

8. The pipette tip container of claim 1, wherein the elongate tube comprises polypropylene.

9. The pipette tip container of claim 1, wherein the elongate tube, having the first inner diameter, is sized to hold a plurality of pipette tips having the second outer diameter.

10. The pipette tip container of claim 9, wherein the cap is formed to allow passage of one pipette tip at a time.

11. The pipette tip container of claim 1, wherein the cap comprises a dispenser and a lid.

12. The pipette tip container of claim 11, wherein the dispenser comprises a lip that is formed to attach to the open end of the elongate tube.

13. The pipette tip container of claim 11, wherein the dispenser defines an aperture sized to allow passage of the pipette tip.

14. The pipette tip container of claim 13, wherein the dispenser further defines a cone-shaped channel that guides the pipette tip toward the aperture.

15. The pipette tip container of claim 13, wherein the lid comprises a hinge that allows the lid to swing open and closed with respect to the dispenser.

16. The pipette tip container of claim 13, wherein the lid comprises an insert sized to pass through the aperture of the dispenser.

17. The pipette tip container of claim 1, wherein the elongate tube has a length in a range of about 3.7 inches to about 4.1 inches.

18. The pipette tip container of claim 1, wherein the elongate tube is formed using an injection mold.

19. The pipette tip container of claim 1, wherein the pipette tip container is sterilized during a manufacturing process.

20. The pipette tip container of claim 1, wherein an inner circumference of the annular protrusion is less than the first inner diameter defined by the sidewall at both the open end of the elongate tube and at the rounded end portion of the elongate tube.

* * * * *